US006000357A

United States Patent [19]

Allison

[11] Patent Number: 6,000,357

[45] Date of Patent: Dec. 14, 1999

[54] BOAT PLANING TABS

[76] Inventor: Darris E. Allison, 106 Main St., Louisville, Tenn. 37777

[21] Appl. No.: 09/057,098

[22] Filed: Apr. 8, 1998

[51] Int. Cl.[6] ..... B63B 1/00

[52] U.S. Cl. ..... 114/271; 114/291

[58] Field of Search ..... 114/56.1, 271, 114/274, 283, 288, 291, 292

[56] References Cited

U.S. PATENT DOCUMENTS

| | | | |
|---|---|---|---|
| 1,726,439 | 8/1929 | Korvin-Kroukovsky . | |
| 3,148,652 | 9/1964 | Canazzi . | |
| 3,363,598 | 1/1968 | Mortrude . | |
| 3,760,756 | 9/1973 | Boden . | |
| 3,991,698 | 11/1976 | Simpson . | |
| 4,027,613 | 6/1977 | Wollard . | |
| 4,233,920 | 11/1980 | Wood et al. . | |
| 4,492,176 | 1/1985 | Arima . | |
| 4,584,959 | 4/1986 | Allison . | |
| 4,619,215 | 10/1986 | Wood et al. . | |
| 4,649,851 | 3/1987 | April | 114/274 |
| 4,726,310 | 2/1988 | Ard et al. . | |
| 4,903,626 | 2/1990 | Haines | 114/291 |
| 4,958,585 | 9/1990 | Caldwell, Jr. . | |
| 5,046,439 | 9/1991 | Goodson et al. . | |
| 5,231,945 | 8/1993 | Ackerbloom | 114/291 |
| 5,351,641 | 10/1994 | Robson . | |
| 5,390,624 | 2/1995 | Barnes . | |
| 5,443,026 | 8/1995 | Wenstadt et al. . | |
| 5,579,711 | 12/1996 | Thomas . | |

*Primary Examiner*—Stephen Avila
*Attorney, Agent, or Firm*—Luedeka, Neely & Graham, P.C.

[57] ABSTRACT

Transitional time through the transplaning speed realm of a high speed sport/utility boat is reduced by narrow, concave planing tabs secured along the inside bottom surface of after-sponsons in alignment with the hull lifting strakes. Such planing tabs originate from the lower transom plane with an abrupt, 1 to 3 inch, step above the intersection edge of the hull bottom surface with the lower transom plane. From the lower transom plane, the planing tab length is terminated at or shortly past the boat propeller plane.

17 Claims, 5 Drawing Sheets

BOAT PLANING TABS

This invention relates to the construction of boat hulls for high speed sport/utility boats.

Personal watercraft of the type used for fishing and racing on inland or protected waters, where large waves or chop is normally not encountered, are often constructed with a modified V-bottom hull. One of the characteristics of such a hull is a sharp, substantially 90° intersection of the hull bottom surfaces with the plane of the hull transom. Another characteristic of the modified V-bottom is a substantially triangular planing pad. The base edge of the triangular pad aligns substantially symmetrically with the edge of intersection between the hull bottom and transom. The apex of the triangular pad points forward from the base edge along the longitudinal/vertical center plane of the hull. As the planing pad continues forward toward the boat bow, the substantially flat, triangular pad shape smoothly transitions into a V form. Consequently, the flat portion of the planing pad may be considered to have a triangular planform with the triangle apex pointed forwardly. At the intersection with the transverse transom plane, the narrow width of the planing pad is delineated on opposite sides of the vertical hull center plane by substantially vertical steps up to the rising V surface of the hull bottom. These vertical steps have the functional characteristics of hull lifting strakes. Several more such longitudinal lifting strakes may be provided along the hull bottom at selectively spaced locations up the V rise of the hull bottom from the planing pad to the chine. Each of these strakes is distinguished by an abrupt edge between a horizontally flared portion of the lower hull surface and a vertical riser face up to the coordinate V surface position. The functional purpose of the strakes is to shed parasitic water spray that would otherwise cling to the hull bottom surface as the boat rises on the water surface with increasing speed.

Another characteristic of high speed sport/utility boats is the use of after-sponsons. After-sponsons are generally provided as longitudinal extensions from the hull aft of the hull transom which laterally flank the boat propulsion unit space behind the transom. After-sponsons have the general function of stabilizing the pitch attitude of the boat. More particularly, after-sponsons provide a righting moment to keep the boat bow down and the hull level as the boat rapidly accelerates from a standing start. At high speed, when the bow and a large percentage of the entire boat hull is clear of the water surface and supported only by ram air pressure, the after-sponsons resist catastrophic up-pitching of the bow from unexpectedly high waves or wind gusts.

The bottom running surface of after-sponsons is usually constructed to plane above the water surface at intermediate boat speeds and greater. As the boat speed approaches mid-velocity, only the central or crotch portion of the hull and planing pad is immersed below the water surface. This immersed portion of the hull provides an elongated boat support area that is inherently pitch stable within a reasonable envelope of pitch angle departure. Consequently, the righting moment forces provided by after-sponsons are not usually necessary for pitch attitude stability. Moreover, if permitted to continue wet contact with the water, the after-sponson bottom surfaces contribute significant surface drag forces opposing the available propulsion power. Accordingly, to free the after-sponson bottom surfaces from the water surface when no longer required to achieve the "planing" speed, the after-sponson bottom surfaces are constructed relative to the hull planing pad at an elevationally higher plane than the planing pad.

Also featured by the fastest few of the high speed sport/utility boats is a stepped transom. This construction feature provides an abrupt, aft end termination for the lower, hull bottom surfaces at a substantially 90° edge of intersection with a narrow strip surface. This strip surface may be about 2 to 5 in. wide for example, depending on the length and weight of the boat and constitutes the lower transom plane. A second or upper transom plane is longitudinally offset aft of the lower transom plane by about 3 to 12 inches, for example, and continues at least up to the hull chine. This upper transom plane structurally supports the boat propulsion unit which may be a traditional outboard or stem propeller drive. The offset between the upper and lower transom planes also contributes to the high speed pitch stability of the boat with an increased moment arm between the drag/support area at the aft end of the planing pad and the propeller thrust point. Also, the offset between the lower and upper transom permits physical positionment of the propeller shaft rotational axis in the same horizontal plane as the planing pad. Consequently, the aft or transom end of the planing pad is longitudinally separated from the propeller plane substantially by the length of the propeller shaft housing.

In the context of this interdependent and sculptured geometry, spray from the planing pad and root of the V-bottom rising from the lower transom plane is dispersed against the substantially flat bottom surfaces of prior art after-sponsons in the transplaning speed realm. Because it is dispersed, the spray offers small impulse force against the after-sponson bottom for a bow-down pitch moment. Hence the bow is disposed to rise when the after-sponson bottom surfaces clear the running surface. This rise of the bow is disadvantageous as it tends to misalign the propeller thrust line and slow the transitional time between mid-speed and top speed.

Additionally, this dispersed spray against the after-sponson bottoms tends to increase the aerodynamic drag behind and under the boat between the after-sponson bottom surface and the water surface by inhibiting a vacuum breaking air flow under the after-sponsons.

It is, therefore, an object of the present invention to increase the rate of acceleration of a sport/utility boat to full speed.

Also an object of the invention is a reduction in the time required for a boat speed to increase from mid-speed planing to maximum speed.

Another object of the present invention is provision of pitch alignment forces on a sport/utility boat to keep the boat and propeller thrust line more substantially level as the boat rises through the transplanar speed realm.

A still further object of the present invention is to reduce parasitic drag on a sport/utility boat at full speed.

SUMMARY OF THE INVENTION

This invention provides a V-bottom boat hull with a pair of after-sponsons extending aft of the transom along laterally opposite sides of a space necessary for the boat propulsion unit. These after-sponsons have planing tabs for bottom running surfaces along the inside edges of the sponsons adjacent to the propulsion unit space.

Characteristically, the planing tab bottoms of the invention are transversely concave between sharply defined longitudinal ridge lines. The planing tab bottom planes originate from the lower transom plane of the boat that terminates the boat planing pad. From an intersection line stepped about 1 to 2 inches above the V-bottom rise surface, the planing tab bottoms extend aft substantially parallel with the planing pad surface for only a short distance past the boat propulsion unit.

The laterally outside ridge of each planing tab is longitudinally aligned in substantially the same vertical plane as an intermediate hull lifting strake.

Preferably, the planing tabs are integrally molded elements of the after-sponsons having substantially smoothly arced surfaces transversely between a respective pair of ridge lines. However, a highly useful alternative may be achieved by an independently formed channel member having divergently flared flanges flanking a flat web surface between the flange roots. Such channel members may be formed from a relatively thin metal plate and attached to a prior art after-sponson bottom surface as by spacers and threaded fasteners.

DESCRIPTION OF THE DRAWINGS

Other features, objects and advantages of the invention will become apparent to those skilled in the art upon review of the following detailed description and drawings wherein.

DETAILED DESCRIPTION

Figure 1:
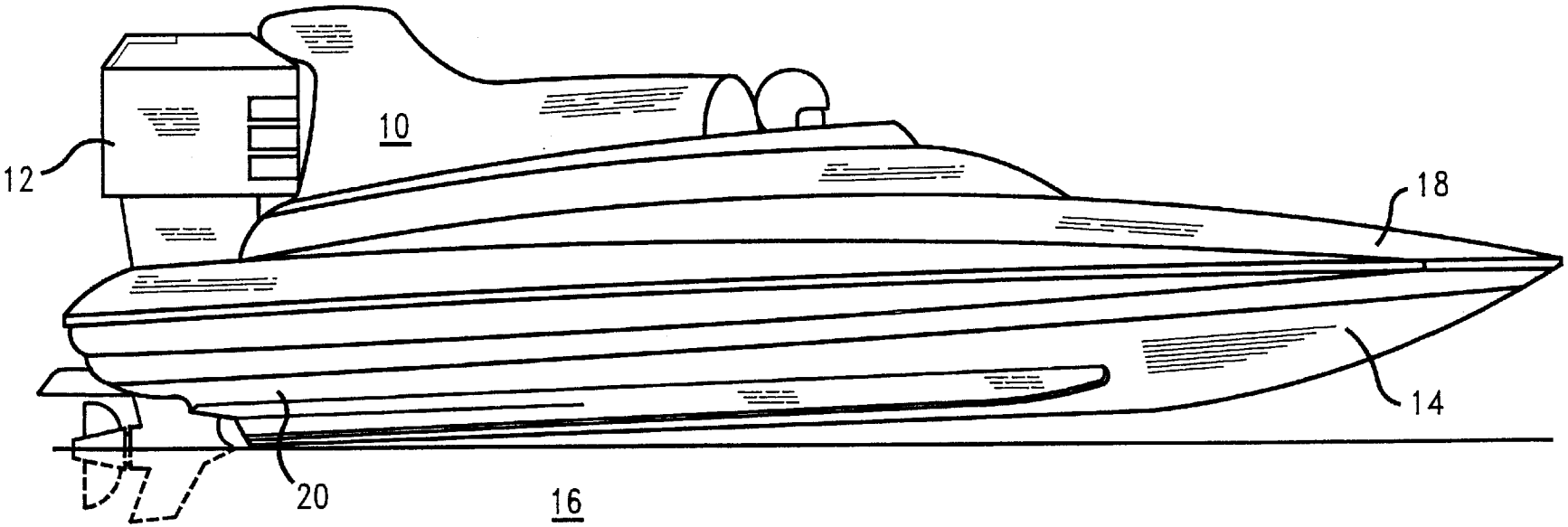
FIG. 1 is pictorial of the present sport/utility boat in high speed planing position.

With respect to FIG. 1, a sport/utility boat 10 is shown in high speed planing position. An outboard engine 12 drives the boat at a top speed of from about 90 mi/hr to about 120 mi/hr. Equivalently, the boat may be driven by a stern drive unit which is characterized by positionment of the engine forward of the boat transom. An upper drive shaft penetrates the transom to drive an outboard propeller unit.

Of particular note from FIG. 1 is the fact that substantially the only contact made by the modified V-bottom of the boat hull 14 with the water running surface 16 in the high speed planing position is an extremely small area at the bottom center of the boat stern 20. The bow 18 of the boat is airborne by the oncoming ram air and the consequential ground effect pressure between the bottom portion of the hull and the water running surface.

Figure 2:
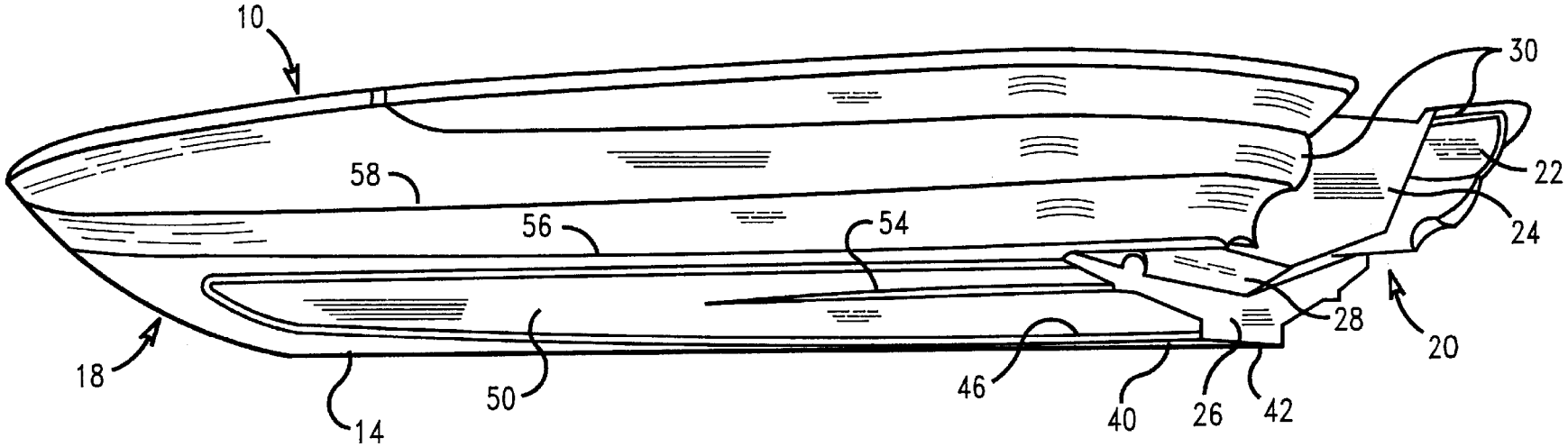
FIG. 2 is a lower, aft quarter view of the full hull of the present invention.
Figure 3:
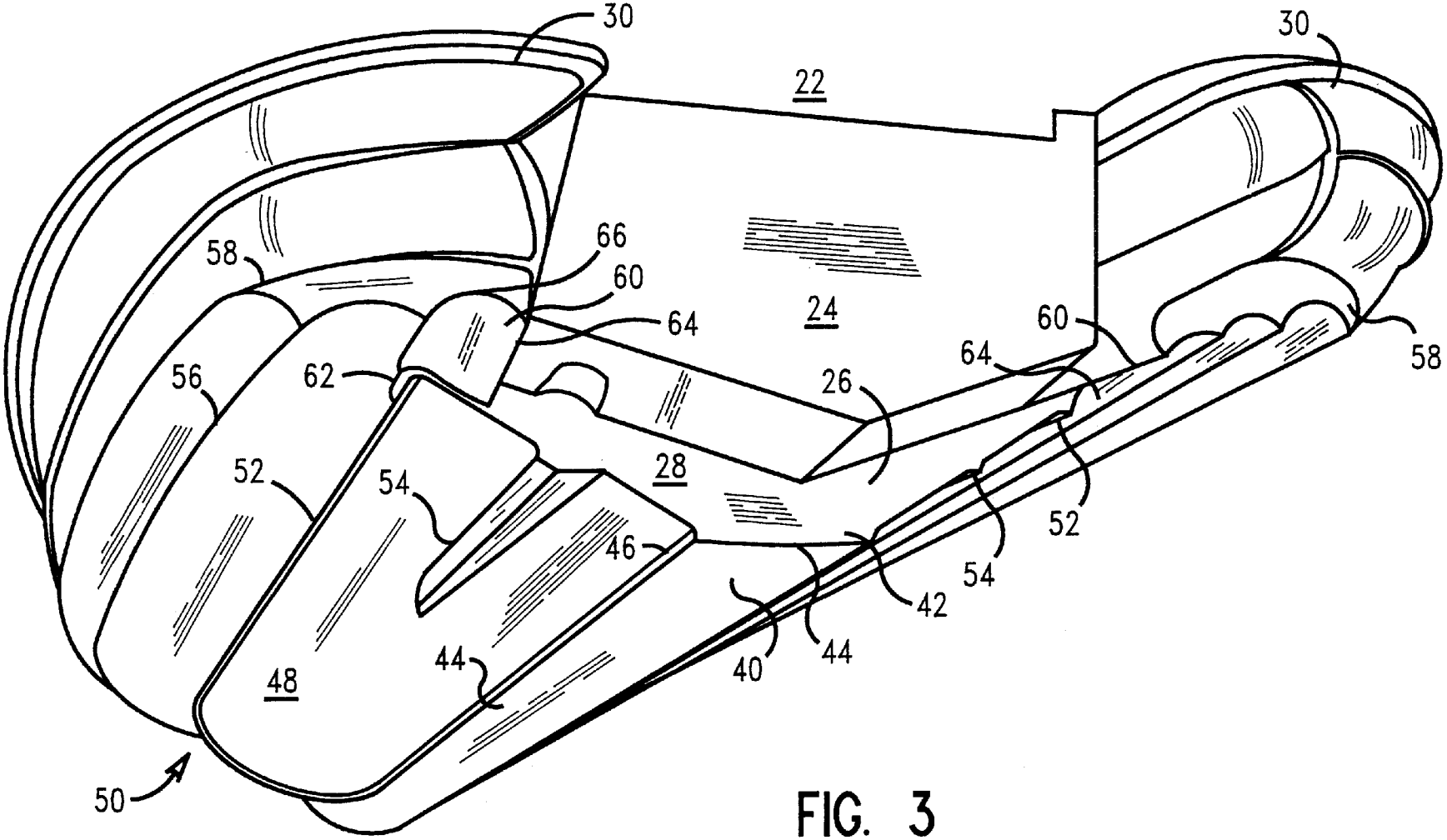
FIG. 3 is an enlargement of the present invention preferred embodiment from a lower, aft quarter perspective.

Referring to FIGS. 2 and 3, the boat stern 20 is distinguished by a pair of after-sponsons 30 that laterally flank the propulsion unit mounting space 22 behind the boat upper transom 24. The preferred embodiment of the invention includes a stepped transom that comprises a narrow, lower transom 26 that is longitudinally forward of the upper transom 24. Both transom portions 24 and 26 are substantially vertical, planar surfaces having relatively abrupt corners with corresponding bottom surfaces. The upper transom 24 may be given some angular departure from vertical to accommodate certain engine and propeller drive configurations. The transom offset surface 28 links the upper edge of the lower transom 26 with the lower edge of the upper transom 24. As a projected portion of the hull bottom, the offset surface 28 is preferably given a shallow V form.

Along the longitudinal centerline of the hull bottom commonly referenced as the keel line is a planing pad 40. At the edge 42 of intersection with the lower transom 26, the planing pad 40 is substantially flat e.g. substantially perpendicular to a vertical plane of symmetry along the longitudinal centerline of the hull 14. Step risers 46 laterally delineate the planing pad 40 with an abrupt vertical step up to the rising panel portion of the hull V-bottom.

As the surface of planing pad 40 develops from the transom edge 42 toward the boat bow 18, the form of the planing pad 40 transitions with a distributed V or dead-rise angle. The relatively flat portion of the planing pad 40 is only a small triangular area forward to the lower transom 26. The transom offset surfaces 28 intersect the lower transom surface 26 about two to six inches above the planing pad lower edge 42.

A transitional bottom form 50, defined as that substantially planar surface below the intermediate lifting strake 52, projects an interior bottom portion having a greater dead-rise angle at the bow than at the stem. Truncated lifting strakes 54 are provided between the intermediate strakes 52 and the step riser 46. Each of these lifting strakes facilitate transition of the boat hull from a stationary or slow moving mode in which the boat weight is primarily supported by buoyant displacement force to a dynamic, speed planing mode. As the boat gains speed, dynamic support pressure between the water surface 16 and hull bottom surface grows to require less displacement volume and dynamic support area. At the impact interface between the water surface and the remaining wet portion of the hull bottom, the water is hurled forward and laterally in a violent spray. Unless induced to separate from the bottom surfaces of impact, surface tension and friction hold a heavy film of spray water against the boat surfaces. Without being bound by theory, it is believed that this heavy film of water, if allowed, burdens the boat bow with undesired weight, disrupts a laminar air flow stream under the boat and generates turbulent drag force on the boat. Reducing these negative consequences is the function of the lifting strakes. An abrupt vertical step for each strake is believed to provide a concentrated separation line to the film of water attached to the hull surfaces by surface tension. This film has a movement along the hull surface aft and laterally until reaching a strake edge. Here, the film adhesion forces are defeated by gravity and the film separates from the boat hull surface.

Since there is an approximate minimum step distance for each strake that will separate the water film from the hull surface, about 1 in. to about 1½ in. for the speed range in point, the number and separation distance between lifting strakes is a finite determination from the dead-rise of the hull bottom and hull width between the chines. The dead-rise is basically the tangent of the hull V-angle relative to the horizontal plane. Hence, the strakes define spray shedding increments for increasing speed ranges.

Lifting strakes 56 are operative in substantially the same manner as described above but in a slower speed realm. Hull support for the operational range of strake 56 is predominately by displacement force. The outer strake 58 is the chine strake which is the first or slowest speed water film shedding edge.

With respect to after-sponsons 30, it is to be first noted that these are buoyant portions of the hull that extend aft of the hull transom 26. The bottom running surfaces of these sponsons is at a level upon the bottom V-gradient generally corresponding with the transom offset surface 28. Hence, when the boat is running at an intermediate or transitional planing speed whereat the transitional bottom form 50 is the predominately wet support surface, the after-sponson bottom surfaces and transom offset surface 28 are generally clear of or emersed from the water surface.

Functionally, the after-sponsons 30 provide counter moment to the hull in the lower speed ranges where the bow 18 tends to rise above the stem 20 thereby misaligning the propeller thrust line. Essentially, an unbalance of buoyant and an dynamic forces pitches the hull about the lower transom edge 42 into an uphill or climbing attitude. Greater speeds increase the aft dynamic force as the bow rises from water surface having the counteracting effect of driving the bow down but at the sacrifice of time and acceleration rate. With after-sponsons, a bow-up pitch departure is opposed by submergence of the after-sponson volume thereby keeping the hull trim and level as it rises with increasing speed upon the transitional bottom form 50.

Upon attaining the transitional planing speed, hull impact spray predominately rises from the lower transom edge. Such impact spray strikes the bottom surfaces of the after-sponsons to the drag force consequence explained previously. This time, however, because the drag forces are applied aft and above the lower transom edge, the moment effect, again, is to pitch the bow up and misalign the propeller thrust line. Misaligned propulsion slows the final transition onto the planing pad 40.

Additionally, the impact spray against the after-sponson bottom surfaces disturbs the slip-stream behind the boat under the after-sponsons thereby creating a partial vacuum in the back-draft. Such back-draft vacuum further retards the boat acceleration rate and elapsed time to top speed.

To this circumstance of transitional spray from the bottom edge of the lower transom plane, a short, narrow planing tab 60 is applied along the inside edge of the two after-sponson bottoms adjacent to the propulsion unit space 22. Characteristically, these planing tabs 60 have an outer edge 62 that is longitudinally aligned with the intermediate lifting strake 52 that defines the outer perimeter of the transitional bottom form 50. Between the planing tabs outer edges 62 and inner edges 64 is a concave or channeled web surface 66. The base plane of this concave web surface 66 is generally aligned about 1 to about 3 inches above the proximate line of intersection between the hull bottom plane and the lower transom plane 26. Longitudinally, the planing tabs 60 extend to the approximate rotational plane of the propeller or slightly past the propeller plane.

In operation, laterally thrust water spray rising from the bottom edge of the lower transom 26 to strike the after-sponson bottom must pass the two planing tab edges 62 and 64. The concavity between the edges 62 and 64 decreases the convergent angle of the edges to assure defeat and separation of the spray supplied bottom film from the lower surfaces of the after-sponsons. Consequently, the planing tabs 60 become concentrated impact and reaction surfaces for the water spray. The reaction consequence of the planing tab recoil from the spray impact is a continuation of external lifting forces on the after-sponsons after the sponson bottoms have risen above the water surface. Additionally, concentration of the water spray against the boat bottom along the edges 62 and 64 permits a smooth flow of back draft air around the after-sponson back-ends above the slow speed strake lines 56 into the propulsion unit space 22. This back-draft air flow has the tendency to break the vacuum that follows behind the boat with a retarding drag much as a parachute.

As an overall performance result of the invention, a positive, bow down pitching moment is maintained on the hull even after it rises upon the intermediate planing "step" of the transitional bottom form 50. Transitional time from an intermediate speed of about 80 miles per hour to a top speed of about 110 miles per hour is reduced from about 1 to about 5 seconds. In a speed based competition, such a time saving may translate to a distance advantage of about 150 ft. to about 750 ft.

FIGS. 2 and 3 illustrate the invention as practiced with an integrally molded hull. In this case, the planing tabs 60 are sculpted into the after sponson bottom as an integral surface. The channel 66 is a smooth surface concavity linking the outside and inside edges 62 and 64.

Figure 4:
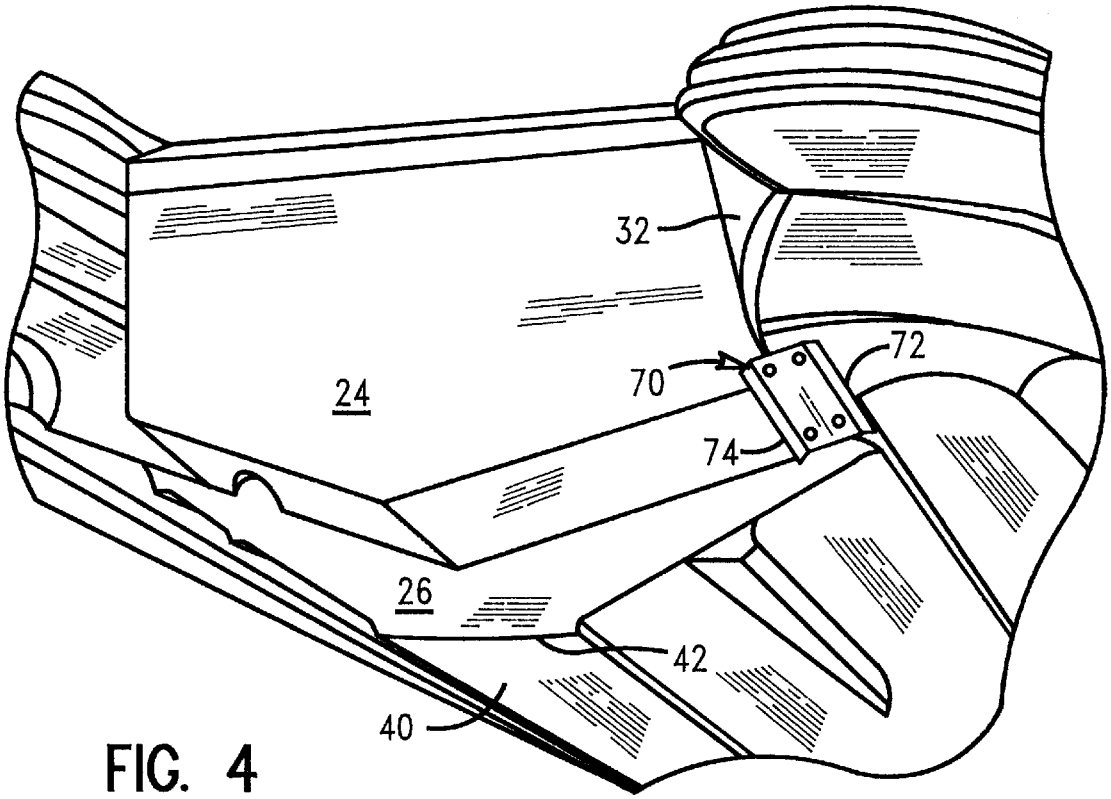
FIG. 4 is an enlargement of the invention alternative embodiment from a lower, aft quarter perspective.
Figure 5:
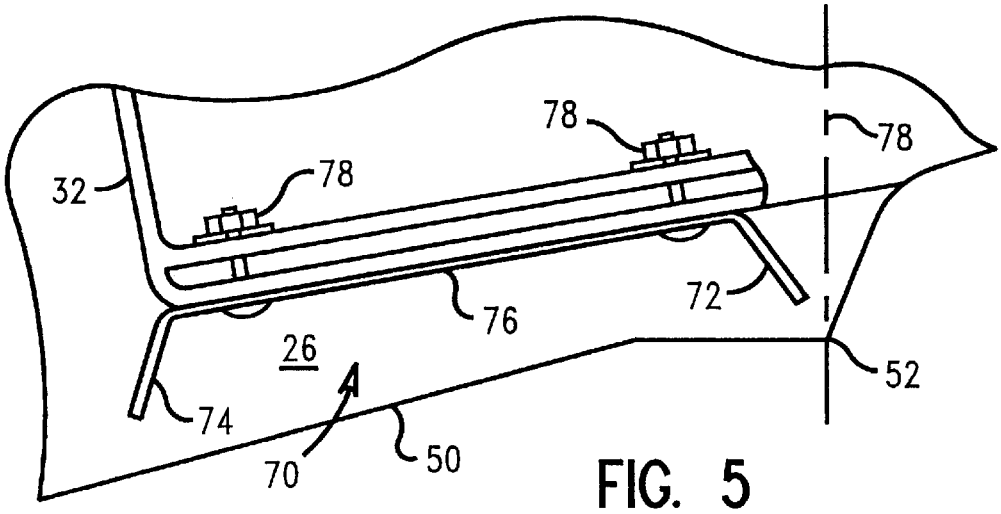
FIG. 5 is an enlarged sectional view of the alternative embodiment as viewed along cutting plane 5—5 of FIG. 4; and, FIG. 6 is a bottom plan view of the embodiment of FIG. 4.
Figure 6:
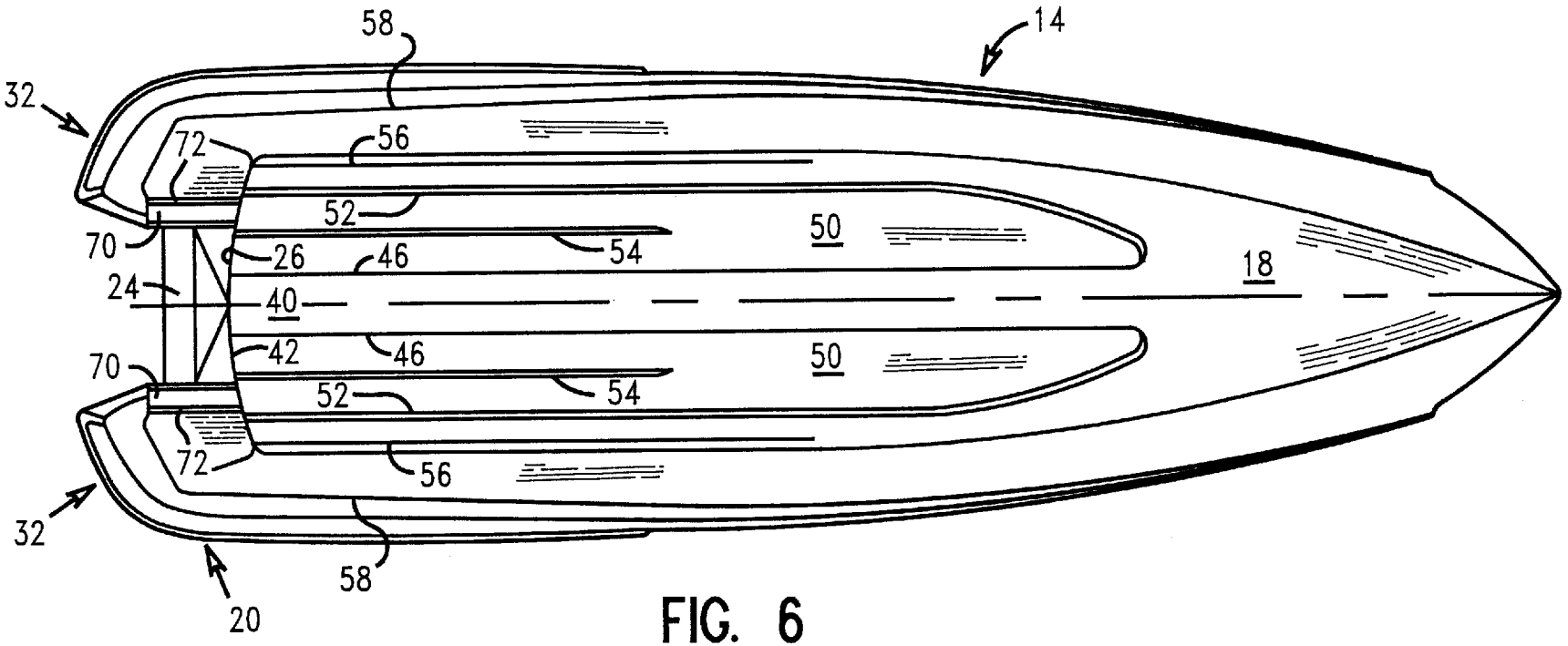

With respect to FIGS. 4 and 5, the planing tab is an independently formed component 70 comprising outside and inside flanges 72 and 74 turned divergently from a linking web 76. Fabrication of independent lifting channels 70 may be from about 1/16 in. to about 1/8 in. aluminum or stainless steel plate, for example. The lifting channels 70 are secured to the bottom of a prior art after-sponson 32 by threaded fasteners such as bolts and self-locking nuts 78. The outside flange edge 72 is aligned with the longitudinal vertical plane 78 shared by the parting edge of intermediate lifting strake 52 that delineates the transitional bottom form 50.

The foregoing description of the preferred and alternative embodiments of the invention have been presented for purposes of illustration and description. These embodiments are not intended to be exhaustive or to limit the invention to the precise forms disclosed. Obvious modifications or variations are possible in light of the above teachings. The embodiments were chosen and described to provide the best illustration of the principles of the invention and its practical application to thereby enable those of ordinary skill in the art to utilize the invention in various other embodiments and with various modifications as is suited to the particular use contemplated. All such modifications and variations are within the scope of the invention as determined by the appended claims when interpreted in accordance with breadth to which they are fairly, legally and equitably entitled.

As my invention therefore,

I claim:

1. In a boat having a V-bottom hull, the improvement comprising:

a plurality of lifting strakes extending longitudinally forward along a bottom surface of said V-bottom hull from a transverse transom plane, said strakes being laterally spaced in increments from a vertical center plane along the longitudinal center of said boat and on opposite sides of said center plane, a pair of after-sponsons on opposite sides of said center plane extending aft of said transom plane and delineating lateral boundaries of a propulsion unit mounting space aft of said transom, said after-sponsons having bottom surfaces intersecting with said transom plane at a stepped increment above a line of V-bottom surface intersection with said transom plane; and, planing tab surfaces disposed longitudinally along said after-sponson bottom surfaces adjacent said propulsion unit mounting space, said planing tab surfaces each comprising a longitudinally extending concavity between a pair of substantially parallel edges for laterally confining and downwardly shedding high speed water spray from a longituding center portion of the bottom surface of said V-bottom hull.

2. The boat improvement as described by claim 1 wherein an outer edge of each planing tab surface most remote from said vertical center plane is substantially aligned longitudinally with one of the lifting strakes.

3. The boat improvement as described by claim 2 wherein a separation distance between said edges is less than a lateral spacing increment of said lifting strakes.

4. The boat improvement as described by claim 1 wherein said planing tab surfaces comprise a smoothly arcuate concavity between said edges.

5. The boat improvement as described by claim 4 wherein said planing tab surfaces are integrally molded portions of said after-sponsons.

6. The boat improvement as described by claim 1 wherein said planing tab surfaces comprise a substantially flat web linking a pair of substantially parallel, divergently flaring flanges.

7. The boat improvement as described by claim 1 wherein said planing tab surfaces extend from said transverse transom plane with a substantially abrupt step above said line of V-bottom surface intersection with said transom plane.

8. The boat improvement as described by claim 7 wherein said abrupt step is about 1 inch to about 2 inches above said line of V-bottom surface intersection.

9. In a boat having a modified V-bottom hull formed substantially symmetrically about a vertical center plane along the length of said boat, the improvement comprising:

a planing pad extending longitudinally along said hull as the central bottom surface thereof, said planing pad being laterally delineated on opposite sides of said center plane by a step riser face;

a plurality of intermediate lifting strakes distributed across intermediate bottom form surfaces of the hull bottom between said step riser face and respective hull chines;

a stepped transom having longitudinally offset first and second rise surfaces connected by a bottom offset surface, the first and second transom rise surfaces being substantially vertical and substantially normal to said center plane, said second transom rise surface being offset aft of said first transom rise surface; and, after-sponsons laterally delineating said stepped transom on opposite sides of said center plane, each of said after-sponsons having a longitudinal planing tab adjacent said stepped transom, said planing tabs having a transversely concave bottom surface.

10. An improved boat as described by claim 9 wherein said planing tabs extend aft from the transom first rise surface substantially along respective planes aligned between the intermediate bottom form surfaces and the bottom offset surface of said stepped transom.

11. An improved boat as described by claim 9 wherein the concave bottom surfaces of said planing tabs are laterally delineated by longitudinal ridges.

12. An improved boat as described by claim 11 wherein a longitudinal delineation ridge respective to said planing tabs most remote from said vertical center plane is longitudinally aligned with an intermediate lifting strake.

13. An improved boat as described by claim 12 wherein said planing tabs are integrally molded portions of said after-sponsons.

14. An improved boat as described by claim 11 wherein the transverse concavity of a planing tab is smoothly curved between said ridges.

15. An improved boat as described by claim 11 wherein the longitudinal ridges respective to each of said tabs are divergently flaring flanges linked therebetween by a substantially flat web.

16. An improved boat as described by claim 10 wherein the planing tab bottom surfaces extend aft from said first transom rise surface about 1 in. to about 2 in. above said intermediate bottom form surfaces.

17. An improved boat as described by claim 15 wherein said planing tabs are secured to said after-sponsons as independent structural elements.

* * * * *